US010316866B2

(12) United States Patent
Amano et al.

(10) Patent No.: US 10,316,866 B2
(45) Date of Patent: Jun. 11, 2019

(54) CONSTRUCTION MACHINE

(71) Applicant: HITACHI CONSTRUCTION MACHINERY CO., LTD., Tokyo (JP)

(72) Inventors: Hiroaki Amano, Tsukuba (JP); Shinya Imura, Toride (JP); Ryouhei Yamashita, Tsuchiura (JP); Shinji Nishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 97 days.

(21) Appl. No.: 15/555,161

(22) PCT Filed: Mar. 10, 2016

(86) PCT No.: PCT/JP2016/057680
§ 371 (c)(1),
(2) Date: Sep. 1, 2017

(87) PCT Pub. No.: WO2017/154186
PCT Pub. Date: Sep. 14, 2017

(65) Prior Publication Data
US 2018/0106278 A1 Apr. 19, 2018

(51) Int. Cl.
*F15B 11/028* (2006.01)
*E02F 9/22* (2006.01)
*F15B 11/044* (2006.01)

(52) U.S. Cl.
CPC ..... *F15B 11/044* (2013.01); *E02F 9/22* (2013.01); *F15B 11/028* (2013.01)

(58) Field of Classification Search
CPC ... F15B 11/044; F15B 11/028; F15B 2211/66; F15B 2211/6658; F15B 2211/8609; F15B 2211/355
See application file for complete search history.

(56) References Cited

FOREIGN PATENT DOCUMENTS

JP 6-264905 A 9/1994
JP 11-256622 A 9/1999
(Continued)

OTHER PUBLICATIONS

Machine English Translation of JP 2014029180. (2014).*
(Continued)

*Primary Examiner* — F Daniel Lopez
*Assistant Examiner* — Daniel S Collins
(74) *Attorney, Agent, or Firm* — Mattingly & Malur, PC

(57) ABSTRACT

A hydraulic excavator is equipped with: an arm cylinder driven by a hydraulic working fluid from a hydraulic pump; a meter-out passage through which the hydraulic working fluid discharged from the arm cylinder flows; a control valve controlling the hydraulic fluid flow rate of the meter-out passage; a pressure sensor detecting a load acting on the arm cylinder; a pressure sensor detecting an operation amount of an operation device operating the arm cylinder; and a controller. The controller alternatively selects a normal operation mode in which the opening area of the control valve is controlled based on an actuator load and the operation amount, and a substitution operation mode in which the opening area of the control valve is controlled based on the operation amount. When the substitution operation mode is selected, a delivery flow rate of the hydraulic pump is further increased as compared with the normal operation mode.

6 Claims, 14 Drawing Sheets

(56) References Cited

FOREIGN PATENT DOCUMENTS

| | | | |
|---|---|---|---|
| JP | 2010-014244 | A | 1/2010 |
| JP | 2014-029180 | A | 2/2014 |
| JP | 2016-1022 | A | 1/2016 |
| KR | 10-2016-0019895 | A | 2/2016 |

OTHER PUBLICATIONS

International Preliminary Report on Patentability received in corresponding International Application No. PCT/JP2016/057680 dated Sep. 20, 2018.
International Search Report of PCT/JP2016/057680 dated Jun. 14, 2016.
Korean Office Action received in corresponding Korean Application No. 10-2017-7022635 dated Oct. 22, 2018.

* cited by examiner

FIG. 7

$$p_{\mathrm{MO}}(PI) = \left(\frac{Q(PI)}{cA_1(PI)}\right)^2 \quad \cdots (1)$$

$$p_{\mathrm{MO}}(PI) = \left(\frac{Q(PI) + \Delta Q(PI)}{cA_0(PI)}\right)^2 \quad \cdots (2)$$

$$Q_1(PI) = \frac{A_0(PI)}{A_1(PI)} Q(PI) = \frac{A_0(PI)}{A_0(PI) - \Delta A(PI)} Q(PI) \quad \cdots (3)$$

CONSTRUCTION MACHINE

TECHNICAL FIELD

The present invention relates to a construction machine equipped with a hydraulic actuator.

BACKGROUND ART

Generally speaking, a construction machine such as a hydraulic excavator is equipped with a hydraulic pump driven by a prime mover, a hydraulic actuator, and flow control valves controlling the supply and discharge of the hydraulic working fluid with respect to the hydraulic actuator. Each flow control valve has a meter-in restrictor and a meter-out restrictor. The meter-in restrictor controls the flow rate of the hydraulic working fluid flowing into the hydraulic actuator from a pump, and the meter-out restrictor controls the flow rate of the hydraulic working fluid discharged from the hydraulic actuator to a hydraulic working fluid tank. Examples of the hydraulic actuator in a hydraulic excavator include a boom cylinder driving a boom and an arm cylinder driving an arm.

In a construction machine equipped with such a hydraulic actuator, it can occur that the weight of the support object of the hydraulic actuator (which, in the case, for example, of an arm cylinder, includes an arm and a bucket (attachment) acts as a load in the same direction as the operational direction of the hydraulic actuator (hereinafter also referred to as the "negative load"). In this case, the operational speed of the hydraulic actuator increases, and there is a shortage of hydraulic working fluid flow rate on the meter-in side, so that there is a fear of generation of a breathing phenomenon (cavitation). The breathing phenomenon may lead to deterioration in the operability of the construction machine and to damage of the hydraulic apparatus.

To solve the above problem, there is known a construction in which a meter-out control valve is provided in a meter-out passage leading to a hydraulic working fluid tank from a hydraulic actuator and in which the opening area of the meter-out control valve is adjusted in accordance with a cylinder pressure, whereby the cylinder speed is suppressed and a breathing phenomenon is prevented (See, for example, Patent Document 1).

PRIOR ART DOCUMENT

Patent Document

Patent Document 1: JP-2010-14244-A

SUMMARY OF THE INVENTION

Problem to be Solved by the Invention

In a state in which warming up has not been sufficiently effected due to the low external air temperature as in the case of winter or a cold district, the viscosity of the hydraulic working fluid becomes high and it takes time to raise a pilot pressure for valve switching and to transmit it. As a result, in the case where the opening area of the meter-out control valve is controlled with the pilot pressure, the controllability of the meter-out control valve markedly deteriorates when the temperature of the hydraulic working fluid is low, so that it is advisable to refrain from performing opening area control on the meter-out control valve.

In the case where opening area control is not performed on the meter-out control valve, the meter-out control valve is fixed at a normal position (a position determined by a spring force pushing a spool/poppet valve in a non-control state). At this time, when, as in the case of the above-mentioned document, the meter-out control valve is of a structure exhibiting a normal open characteristic (a characteristic in which a maximum opening is assumed at a normal position), the meter-out side hydraulic working fluid restrictor is widened. Thus, in the case where the hydraulic cylinder is operated in the direction of fall, the direction being due to its own weight, it is impossible to raise a sufficient meter-out pressure, and the cylinder speed increases, so that there is a fear of generation of a breathing phenomenon.

The present invention has been made in view of the above problem. It is an object of the present invention to provide a construction machine which can prevent a breathing phenomenon of the hydraulic actuator even in the case where performing of the opening area control of the meter-out control valve is refrained from because of a low hydraulic working fluid temperature.

Means for Solving the Problem

To achieve the above object, there is provided, in accordance with the present invention, a construction machine including: a hydraulic pump pumping up a hydraulic working fluid in a tank and delivering it; a hydraulic actuator driven by the hydraulic working fluid delivered from the hydraulic pump; a meter-out passage through which the hydraulic working fluid discharged from the hydraulic actuator flows; a meter-out control valve provided in the meter-out passage and controlling the hydraulic working fluid flow rate in the meter-out passage by varying an opening area; a load sensor detecting a load acting on the hydraulic actuator; an operation device operating the hydraulic actuator; and an operation amount sensor detecting the operation amount of the operation device, the construction machine further including a control device configured to select one of a normal operation mode in which the opening area of the meter-out control valve is controlled based on the load and the operation amount and a substitution operation mode in which the opening area of the meter-out control valve is controlled based on the operation amount. The control device is configured to further increase the delivery flow rate of the hydraulic pump when the substitution operation mode is selected than when the normal operation mode is selected.

Advantages of the Invention

According to the present invention, even in the case where the opening area control of the meter-out control valve is not conducted, the pump flow rate is further increased than at the time of normal operation, whereby it is possible to prevent a breathing phenomenon of the hydraulic actuator.

BRIEF DESCRIPTION OF THE DRAWINGS

FIG. 7 is a diagram illustrating a pump flow rate correction value determination method according to the first embodiment of the present invention.

MODES FOR CARRYING OUT THE INVENTION

In the following, embodiments of the present invention will be described with reference to the drawings. In the description, the construction machine consists of a hydraulic excavator by way of example.

First Embodiment

In the present embodiment, there will be described how to prevent a breathing phenomenon in the case where the hydraulic working fluid is at low temperature and where the responsiveness of the mechanism adjusting the meter-out opening area in accordance with the actuator load deteriorates.

Figure 1:
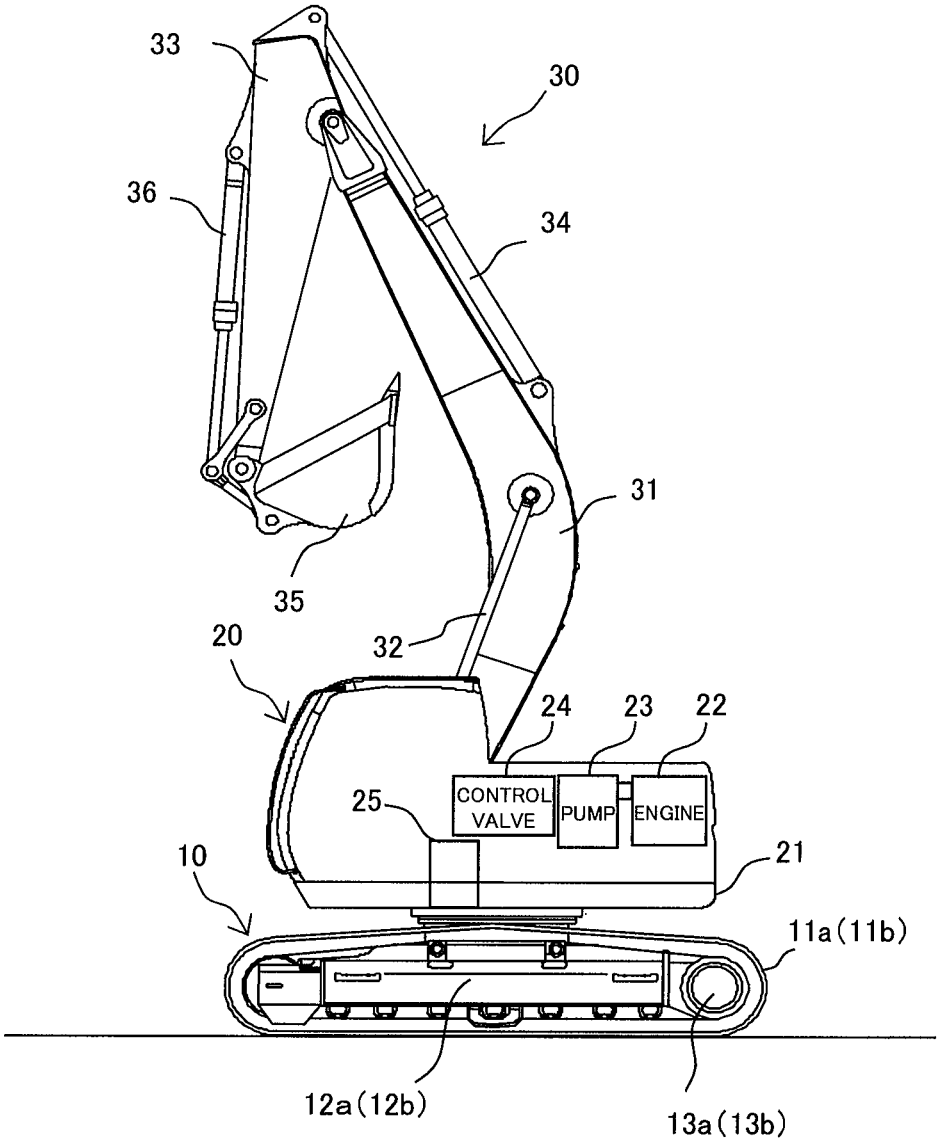
FIG. 1 is an overall view of a construction machine according to the present invention.

In FIG. 1, the hydraulic excavator is equipped with a track structure 10, a swing structure 20 swingably provided on the track structure 10, and a front work device 30 attached to the swing structure 20.

The track structure 10 is composed of a pair of crawlers 11*a* and 11*b*, crawler frames 12*a* and 12*b* (solely one of which is shown in FIG. 1), a pair of traveling hydraulic motors 13*a* and 13*b* independently drive-controlling the crawlers 11*a* and 11*b*, a speed reduction mechanism thereof, etc.

The swing unit 20 is equipped with a swing frame 21, an engine 22 as a prime mover provided on the swing frame 21, a hydraulic pump 23 rotary driven by an engine 22 and pumping up a hydraulic working fluid in a hydraulic working fluid tank 40 (See FIG. 2) and delivering it, hydraulic actuators (e.g., hydraulic cylinders 32, 34, and 36) driven by the hydraulic working fluid delivered from the hydraulic pump 23, and a control valve unit 24 equipped with a plurality of flow control valves (e.g., a flow control valve 41 in FIG. 2) distributing the hydraulic working fluid delivered from the hydraulic pump 23 to the hydraulic actuators. Further, the swing structure 20 is equipped with a swing hydraulic motor 25 and a speed reduction mechanism thereof, and the swing hydraulic motor 25 swingably drives an upper swing structure 20 (swing frame 21) with respect to the lower track structure 10.

Further, the front work device 30 is mounted on the swing structure 20. The front work device 30 is composed of a boom 31 the proximal end portion of which is pivotably supported in a freely rotating manner by the swing structure 20, a boom cylinder 32 for driving the boom 31, an arm 33 pivotably supported in a freely rotating manner by a portion in the vicinity of the distal end portion of the boom 31, an arm cylinder 34 for driving the arm 33, a bucket 35 pivotably supported in a rotatable manner by the distal end of the arm 33, a bucket cylinder 36 for driving the bucket 35, etc.

Figure 2:
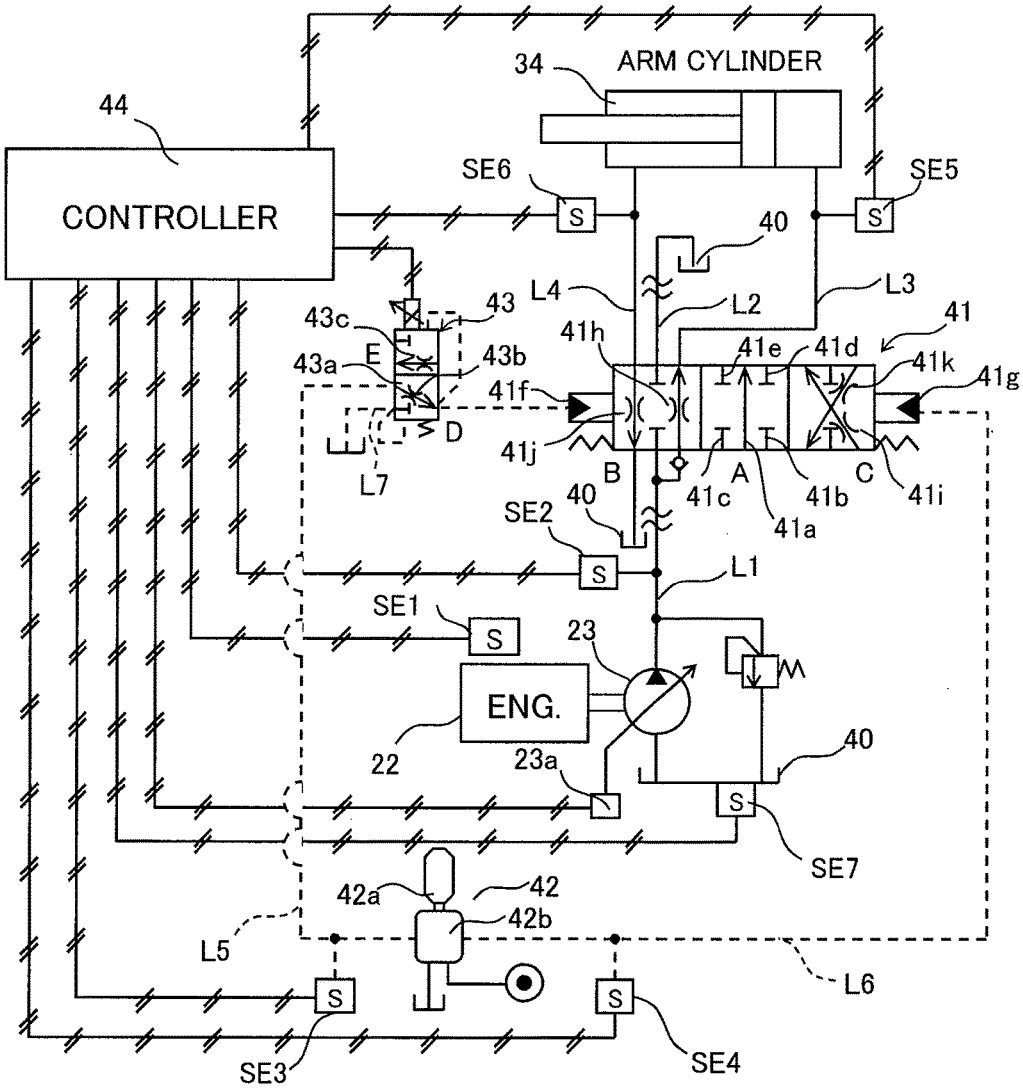
FIG. 2 is a conceptual diagram illustrating the construction of a hydraulic circuit and an apparatus according to a first embodiment of the present invention.

FIG. 2 is a conceptual diagram illustrating the construction of a hydraulic circuit and an apparatus related to the arm cylinder 34 in the hydraulic control apparatus of a construction machine according to the first embodiment of the present invention. While in the following description the hydraulic actuator consists of the arm cylinder 34, the present embodiment is also applicable to some other hydraulic actuator such as the bucket cylinder 36 so long as the hydraulic actuator is one in which the operational direction of the driving object of the hydraulic actuator, the direction being due to the weight of the driving object, can coincide with the operational direction of the driving object driven by the hydraulic actuator.

In FIG. 2, the hydraulic control apparatus according to the present invention is equipped with an engine 22, a hydraulic pump 23 rotary driven by the engine 22, a hydraulic working fluid tank 40 which is the hydraulic working fluid supply source to the hydraulic pump 23, and a pilot valve 42 which is connected to a delivery line L1 of the hydraulic pump 23 and which is an arm operation device controlling the flow rate and direction of the hydraulic working fluid supplied to the arm cylinder 34.

The revolution speed of the engine 22 is detected by a pickup sensor SE1 and input to a controller 44.

The hydraulic pump 23 is of a variable displacement type and is equipped with a regulator (pump delivery flow rate control device) 23*a* varying the displacement volume (delivery flow rate) of the hydraulic pump 23 based on a command from the controller 44. The delivery pressure of the hydraulic pump 23 is detected by a pump delivery pressure sensor SE2, and is input to the controller 44.

The control valve 41 is of a center bypass type, and a center bypass portion 41*a* is connected to a center bypass line L2 at a neutral position A. The downstream side of the center bypass line L2 is connected to a hydraulic working fluid tank 40. Further, the control valve 41 has a pump port 41*b*, a tank port 41*c*, and actuator ports 41*d* and 41*e*. The pump port 41*b* is connected a delivery line L1. The tank port 41*c* is connected to the tank 40. The actuator ports 41*d* and 41*e* are connected to a bottom side hydraulic fluid chamber or a rod side hydraulic fluid chamber of the arm cylinder 34 via an actuator line L3 or L4.

The pilot valve 42 has an operation lever 42*a*, and a pilot pressure generation portion 42*b* containing a pair of pressure reducing valves (not shown), and the pilot pressure generation portion 42*b* is connected to pilot pressure receiving portions 41*f* and 41*g* of the control valve 41 via pilot lines L5 and L6. When the operation lever 42*a* is operated, the operation pilot pressure generation portion 42*b* operates one of the pair of pressure reducing valves in accordance with the operational direction thereof, and outputs a pilot pressure in accordance with the operation amount to one of the pilot lines L5 and L6. The operation pilot pressure generated in L5 and L6 is detected by pilot pressure sensors SE3 and SE4, and output to the controller 44.

As its switching positions, the control valve 41 has a neutral position A, a switching position B, and a switching position C. When a pilot pressure is imparted to the pressure receiving portion 41*f* by the pilot line L5, switching is effected to the switching position B on the left-hand side as seen in the drawing. At this time, the actuator line L3 is on the meter-in side, and L4 is on the meter-out side. The hydraulic working fluid is supplied to the bottom side hydraulic fluid chamber of the arm cylinder 34, and the piston rod of the arm cylinder 34 extends. On the other hand, when a pilot pressure is imparted to the pressure receiving portion 41*g* by the pilot line L6, switching is effected to the position C on the right-hand side as seen in the drawing. At this time, the actuator line L4 is on the meter-in side, and L3 is on the meter-out side. The hydraulic working fluid is supplied to the rod side hydraulic fluid chamber of the arm cylinder 34, and the piston rod of the arm cylinder 34 contracts. The expansion of the piston rod of the arm cylinder 34 corresponds to the operation of drawing in the arm, that is, the crowding operation, and the contraction of the piston rod of the arm cylinder 34 corresponds to the operation of pushing out the arm, that is, the damping operation.

The pressure of the bottom side hydraulic fluid chamber (hereinafter referred to as the bottom pressure) can be detected by a pressure sensor SE5, and the pressure of the rod side hydraulic fluid chamber (hereinafter referred to as the rod pressure) can be detected by a pressure sensor SE6. The detection pressures of the pressure sensors SE5 and SE6 are input to the controller 44. In the present embodiment, the pressure sensor SE5 is utilized as a load sensor detecting the load acting on the arm cylinder 34.

Further, the control valve 41 has meter-in restrictors 41*h* and 41*i* and meter-out restrictors 41*j* and 41*k*. These restrictors 41*h*, 41*i*, 41*j*, and 41*k* function as variable restrictors varying in opening area in accordance with the switching position of the control valve 41. The meter-out restrictors 41*j* and 41*k* cause the control valve 41 to function as a meter-out control valve controlling the flow rate of the hydraulic working fluid in the meter-out passage (actuator line L4 or L3). When the control valve 41 is at the switching position B, the hydraulic working fluid supplied to the arm cylinder 34 is controlled by the meter-in restrictor 41*h*, and the return flow rate from the arm cylinder 34 is controlled by the meter-out restrictor 41*j*. On the other hand, when the control valve 41 is at the switching position C, the hydraulic working fluid supplied to the arm cylinder 34 is controlled by the meter-in restrictor 41*i*, and the return flow rate from the arm cylinder 34 is controlled by the meter-out restrictor 41*k*.

Further, the hydraulic control apparatus of the construction machine according to the present embodiment is equipped with a solenoid proportional valve 43 installed in the pilot line L5. The solenoid proportional valve 43 is driven based on a solenoid valve electric current (control signal) input from the controller 44, and functions as a control device (meter-out control valve control device) controlling the opening area of the meter-out restrictor 41*j* of the control valve 41. The solenoid valve electric current value input to the solenoid proportional valve 43 assumes a value somewhere between a solenoid proportional valve minimum electric current IMIN (e.g., 100 mA) which is zero or more and a solenoid proportional valve maximum electric current IMAX (e.g., 600 mA). When the solenoid valve electric current value IMIN, a solenoid valve spool 43*a* is at a switching position D, and the opening of a hydraulic line 43*b* is maximum. At this time, the pilot pressure generated at the operation pilot pressure generation portion 42*b* is directly guided to the pressure receiving portion 41*f*. When the solenoid valve electric current value IMAX, a solenoid valve spool a is at a switching position F, and interrupts the hydraulic line 43*b*, thereby preventing the pilot pressure generated in the pilot line L5 from being guided to the pressure receiving portion 41*f*. At the same time, the opening of the hydraulic line 43*c* is maximum, and the hydraulic working fluid at the pressure receiving portion 41*f* is discharged to a drain circuit L7. When the solenoid valve electric current value is in a control region between IMIN and IMAX, the solenoid proportional valve 43 controls the spool 43*a* between the switching position D and the switching position E, whereby the hydraulic line 43*b* from the operation pilot pressure generation portion 42*b* to the pressure receiving portion 41*f* is restricted. At the same time, the hydraulic working fluid of the pressure receiving portion 41*f* is partially discharged to the drain circuit L7 through the hydraulic line 43*c*. Through this operation, an arbitrary pressure not higher than the pilot pressure generated in the operation pilot pressure generation portion 42*b* can be guided to the pressure receiving portion 41*f* as the pilot pressure.

The hydraulic working fluid tank 40 is equipped with a hydraulic working fluid temperature sensor (temperature sensor) SE7, and the temperature of the hydraulic working fluid in the hydraulic working fluid tank 40 is detected and output to the controller 44.

Further, the hydraulic control apparatus of the construction machine according to the present embodiment is equipped with the controller 44. The controller 44 is formed by a computer, which acquires the values of the sensors SE1 through SE7 and controls a pump regulator 23*a* and a solenoid proportional valve 43.

Figure 12:
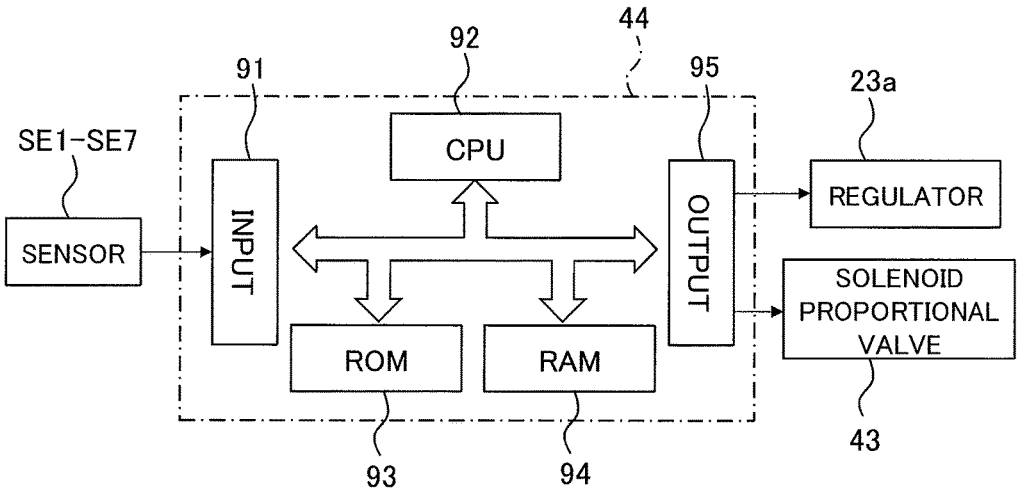
FIG. 12 is a construction diagram of controller hardware according to the present invention.

FIG. 12 shows the hardware construction of the controller 44. The controller 44 has an input unit 91, a central processing unit (CPU) 92 that is a processor, read-only memory (ROM) 93 and random access memory (RAM) 94 that are storage devices, and an output unit 95. The input unit 91 inputs signals from the sensors SE1 through SE7, and performs A/D conversion. The ROM 93 is a storage medium storing a control program for executing the processing illustrated in the flowcharts of FIG. 3, etc. described below, and various items of information, etc. necessary for executing the processing of the flowcharts. In accordance with the control program stored in the ROM 93, the CPU 92 performs a predetermined computation processing with respect to signals acquired from the input unit 91, the memory 93, and the memory 94. The output unit 95 prepares an output signal in accordance with the computation result at the CPU 92, and outputs the signal to the solenoid proportional valve 43 and the pump regulator 23*a*, whereby it is possible to control the opening area of the meter-out restrictor 41*j* of the control valve 41 and to control the delivery flow rate of the hydraulic pump 23. While the controller 44 of FIG. 12 is equipped with semiconductor memories, i.e., the ROM 93 and the RAM 94, as the storage devices, this allows replacement by some other device so long as it is a storage device. For example, a magnetic storage device such as a hard disk drive may be provided.

Figure 3:
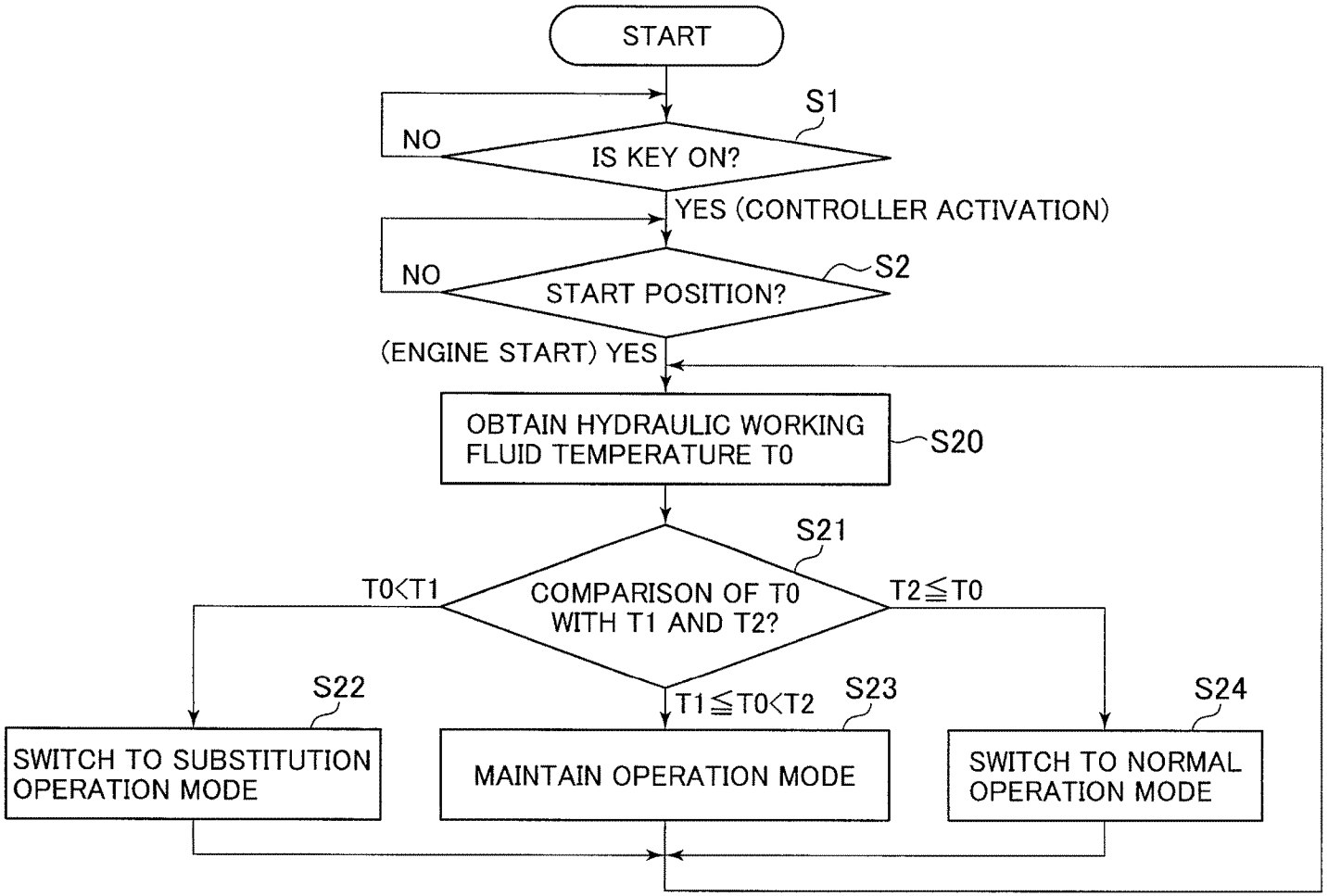
FIG. 3 is a flowchart illustrating an operational mode switching control according to the first embodiment of the present invention.

FIG. 3 shows a flowchart for the operational mode switching control in the first embodiment. It is to be assumed that, at the start of the flowchart, a key switch is at an OFF position, and that a normal operation mode is selected as the machine body operation mode.

In step S1, it is determined whether or not the key switch is switched to the ON position (key ON) by the operator. When it is determined that the system is in the key ON mode, the controller 44 is activated, and the procedure advances to step S2. In step S2, it is determined whether or not the key switch is switched to the start position from the ON position. When it is determined that the key is at the start position, the engine 22 is started, and the procedure advances to step S20. Next, in step S20, the controller 44 acquires the hydraulic working fluid temperature T0 detected by the hydraulic working fluid temperature sensor SE7, and the procedure advances to step S21.

In step S21, the controller 44 compares with each other the hydraulic working fluid temperature T0, the meter-out opening limitation non-effective temperature threshold value T1, and the meter-out opening limitation effective temperature threshold value T2. Between the meter-out opening limitation non-effective temperature threshold value T1 and the meter-out opening limitation effective temperature threshold value T2, the following relationship holds good: T1<T2. For example, the maximum value of the temperature range where the viscosity of the hydraulic working fluid is high and where the meter-out opening limitation control is difficult can be set as the meter-out opening limitation non-effective temperature threshold value T1, and a value higher than the temperature range concerned can be set as the meter-out opening limitation non-effective temperature threshold value T2. Further, the difference between T1 and T2 is set to a value that is sufficiently large with respect to a short-period change amount of the hydraulic working fluid temperature (for example, T1=0° C. and T2=5° C.)

When T0<T1 in step S21, the procedure advances to step S22. When T1≤T0<T2, the procedure advances to step S23, and when T2≤T0, the procedure advances to step S24. In step S22, the operation mode of the machine body (the initial value of which is the normal operation mode) is switched to a substitution operation mode (described below), and the procedure returns to step S20. In step S23, the operation mode at that point in time is maintained, and the procedure returns to step S21. In step S24, the operation mode is switched to the normal operation mode (described below), and the procedure returns to step S20.

Next, referring to FIGS. 4 and 5, the control of the delivery flow rate of the hydraulic pump 23 and of the solenoid proportional valve 43 by the controller 44 in the normal operation mode and the substitution operation mode will be described.

Figure 4:
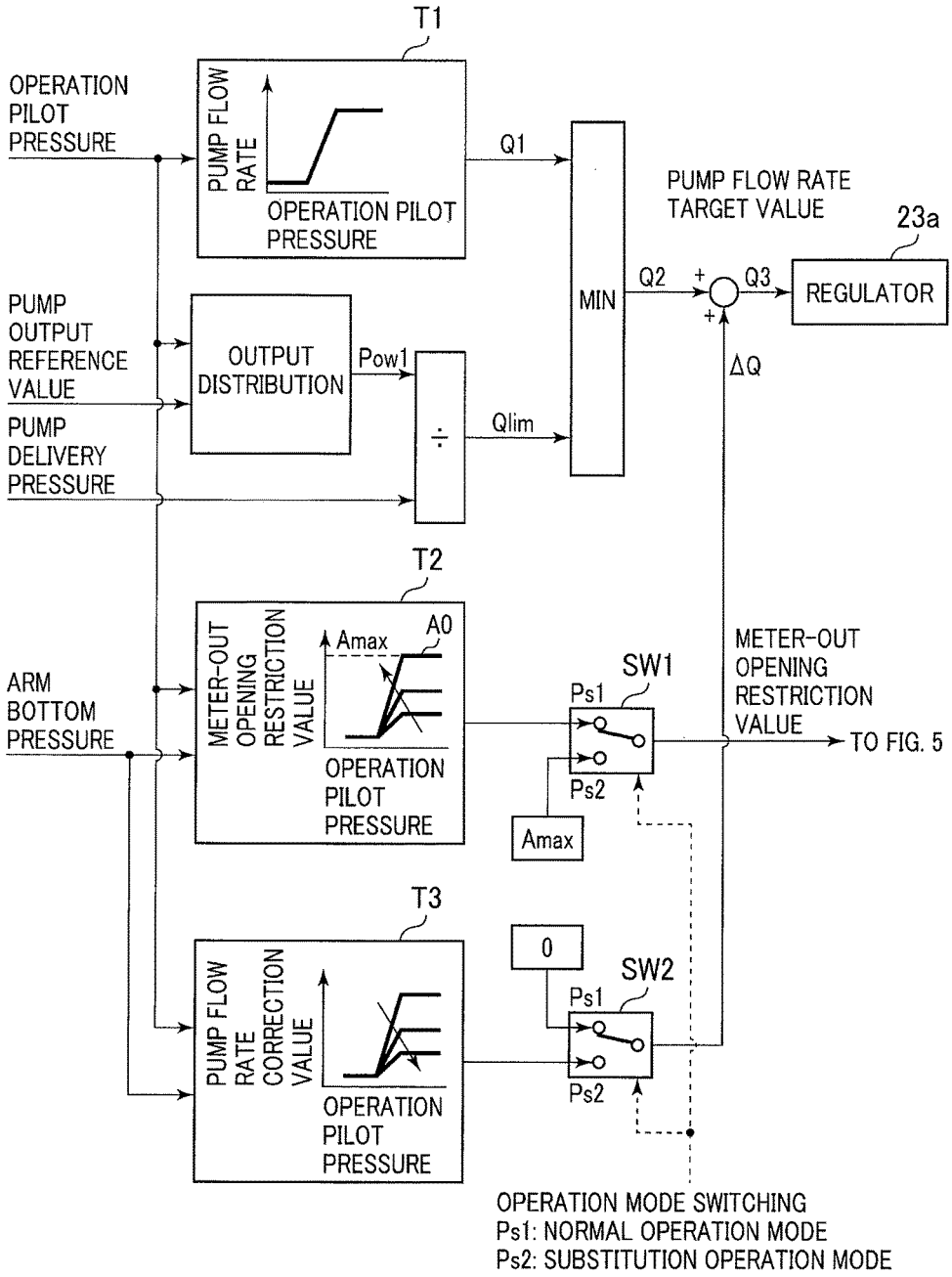
FIG. 4 is a control block diagram of a hydraulic pump and a meter-out opening limitation computation according to the first embodiment of the present invention.

In FIG. 4, by using table T1, a flow rate reference value Q1 of the pump 23 is determined from an arm crowding operation pilot pressure (arm crowding operation amount) detected by the pilot pressure sensor SE3. Further, an arm crowding power demanded value POW1 is computed from a pump output reference value set such that the engine speed does not undergo lug-down and from an arm crowding operation amount, and this is divided by the pump delivery pressure detected by the pump delivery pressure sensor SE2, whereby a pump flow rate limitation value Qlim in terms of horsepower is computed. The minimum value of the flow rate reference value Q1 and the pump flow rate limitation value Qlim in terms of horsepower will be regarded as a pump flow rate demanded value Q2.

Further, from the arm crowding operation pilot pressure (arm crowding operation amount) and the arm bottom pressure (arm cylinder load) detected by the pressure sensor SE5, the opening area value of the meter-out restrictor 41*j* (hereinafter also referred to as the meter-out opening limitation value) is computed by using the table T2. The table T2 has a characteristic in which the larger the arm crowding operation pilot pressure (the larger the arm speed), the large the meter-out opening limitation value. The arrow in the table T2 indicates the magnitude of the arm bottom pressure, and the table T2 is of a characteristic in which the lower the arm bottom pressure (i.e., when the liability of generation of breathing in the arm cylinder 34 is high), the smaller the meter-out opening limitation value. The graph when the arm bottom pressure is at the highest level coincides with the meter-out opening characteristic A0 of the control valve 41 (See FIG. 6 referred to below).

The switching position of the switch SW1 is selectively switched in accordance with the operation mode determined in the flowchart of FIG. 3. In the normal operation mode, switch SW1 is switched to a position Ps1, and the opening area value calculated by using the table T2 is output to the table T4 of FIG. 5. On the other hand, in the substitution operation mode, the switch SW1 is switched to a position Ps2, and the maximum value Amax (See FIG. 6 referred to below) when the control valve 41 assumes the meter-out opening characteristic A0 is output to the table T4 of FIG. 5 without taking the arm bottom pressure into consideration.

Figure 5:
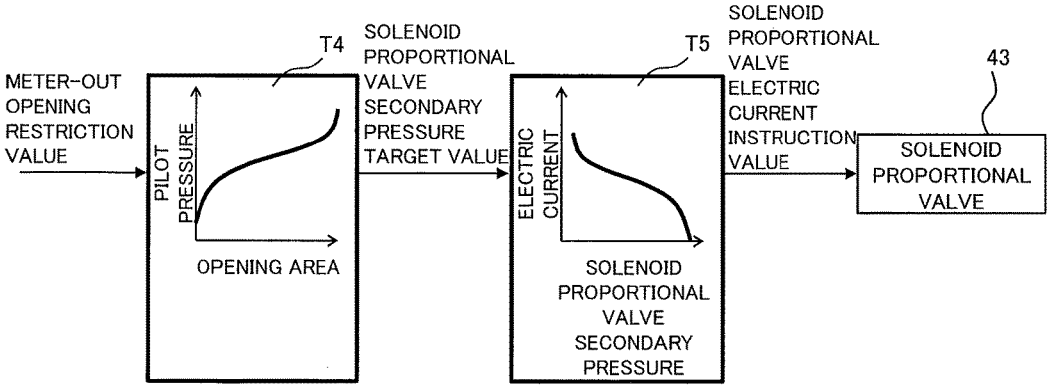
FIG. 5 is a control block diagram illustrating a solenoid proportional valve electric current instruction value computation according to the first embodiment of the present invention.

In FIG. 5, to be described will be a computation method for determining the control signal (solenoid proportional valve electric current instruction value) to the solenoid proportional valve 43 based on the meter-out opening limitation value. First, from the meter-out opening limitation value of the table T2, a solenoid proportional valve secondary pressure target value (pilot pressure) is computed by using the table T4. Here, in the table T4, the vertical axis and the horizontal axis of the opening characteristic of the meter-out restrictor 41*j* with respect to the pressure of the pressure receiving portion 41*f* are interchanged with each other. When Amax is input to T4 (when SW1 is at Ps2 in the substitution operation mode), the solenoid proportional valve secondary pressure target value assumes a maximum value.

Next, by using the table T5, the solenoid valve electric current instruction value is computed from the solenoid proportional valve secondary pressure target value of T4. Here, in the table T5, the vertical axis and the horizontal axis of the electric current-secondary pressure characteristic (I-P characteristic) of the solenoid proportional valve 43 are interchanged with each other. When the solenoid proportional valve secondary pressure target value assumes a maximum value (when SW1 is at Ps2 in the substation operation mode), the electric current value is zero, so that the control valve 41 is driven by the pilot pressure generated by the operation pilot pressure generation portion 42*b*. Here, when the substation operation mode is selected, the electric current instruction value calculated by the table T5 is zero. However, it may also be a value in excess of zero so long as it is within the electric current value range in which the solenoid proportional valve 43 is retained at the normal position.

As described above, through computation using the tables T4 and T5, the controller 44 outputs the solenoid valve electric current instruction value of T5 to the solenoid proportional valve 43, and controls the solenoid proportional valve 43 such that the opening area of the meter-out restrictor 41*j* assumes the target value.

Next, referring back to FIG. 4, a method of computing a pump flow rate correction value ΔQ will be described. From the arm crowding operation pilot pressure and the arm bottom pressure, the pump flow rate correction value is calculated by using the table T3. The table T3 is of a characteristic in which the higher the operation pilot pressure, the further the pump flow rate correction value ΔQ increases. The arrow in the table T3 indicates the magnitude of the arm bottom pressure, and the table T3 is of a characteristic in which the lower the bottom pressure (actuator load) (the higher the possibility of generation of breathing in the arm cylinder), the further the pump flow rate correction value ΔQ increases. Further, it is of a characteristic in which when the bottom pressure is high (when there is little possibility of generation of breathing in the arm cylinder), the pump flow rate correction value ΔQ decreases as compared with the case where the bottom pressure is low. The pump flow rate correction value ΔQ calculated by using the table T3 is output to the switch SW2.

The switching position of the switch SW2 is alternatively switched in accordance with the operation mode determined by the flowchart of FIG. 3. In the normal operation mode, the switch SW2 is switched to the position Ps1, and zero is output as the pump flow rate correction value ΔQ. On the other hand, in the substitution operation mode, the switch SW2 is switched to the position Ps2, and the value calculated by using the table T3 is output as the pump flow rate correction value ΔQ.

The pump flow rate correction value ΔQ output from the switch SW2 is added to the pump flow rate demanded value Q2, whereby the final pump flow rate target value Q3 is determined. Based on the pump flow rate target value Q3, an electric current instruction value to the pump regulator 23*a* is generated. The controller 44 outputs the electric current instruction value to the pump regulator 23*a*, and controls the pump regulator 23*a* such that the delivery flow rate of the hydraulic pump 23 attains the target value (Q2 or Q2+ΔQ). Due to this operation, when the substitution operation mode is selected, the pump flow rate correction value ΔQ which is larger than zero is added to Q2, so that the delivery flow rate of the hydraulic pump 23 is increased as compared with the case where the normal operation mode is selected and where Q2 is constantly maintained, and the shortage of flow rate on the meter-in side is mitigated/eliminated.

Figure 6:
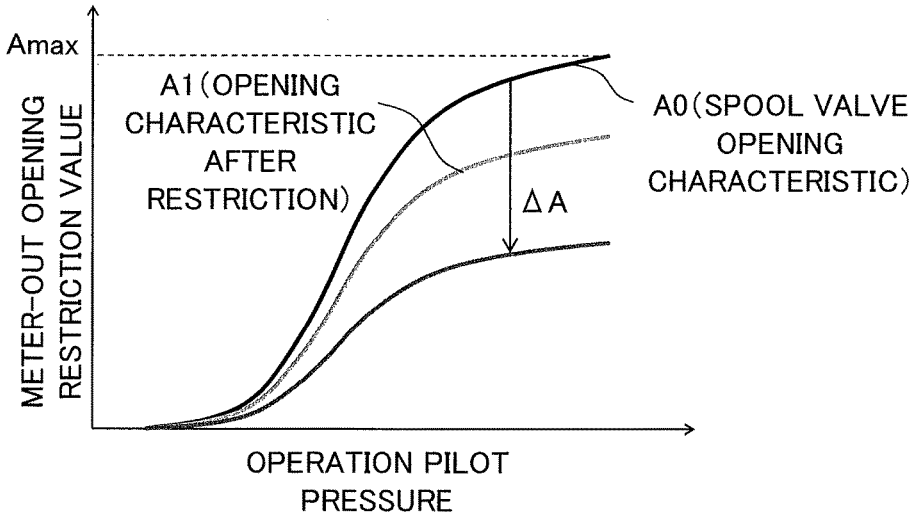
FIG. 6 is a diagram illustrating a meter-out opening limitation value computation table according to the first embodiment of the present invention.

Next, the role of the table T2 will be described with reference to FIG. 6. FIG. 6 is a schematic view of the table T2. In table T2, when the level of the arm bottom pressure is highest, that is, when breathing phenomenon is not easily generated in the arm cylinder, the meter-out opening limitation value assumes the meter-out opening characteristic (A0 in the drawing) of the control valve 41. At this time, the arm crowding operation pilot pressure and the solenoid valve secondary pressure coincide with each other, so that a reduction in the pilot pressure is not effected. As indicated at A1 in the drawing, in the case where the arm bottom pressure is low and where there is the possibility of generation of a breathing phenomenon, the characteristic in which the opening is reduced by a fixed degree from A0 is regarded as the meter-out opening limitation value. At this time, the meter-out restrictor 41*j* is restricted, so that the arm cylinder rod pressure increases, and the cylinder speed decreases, thereby preventing breathing. In the case where the arm bottom pressure is further reduced, the characteristic in which the opening is further reduced from A1 is regarded as the meter-out opening limitation value. The degree to which the opening is reduced with respect to the arm bottom pressure is derived from an experiment.

Next, by using the equations of FIG. 7, the method of deriving the table T3 will be described. Assuming that the table T2 is determined through experiment, the requisite meter-out pressure pMO (which coincides with the arm cylinder rod pressure here) for preventing the breathing phenomenon is derived from equation (1). Here, Q(PI) corresponds to the pump reference flow rate corresponding to the operation pilot pressure PI, c corresponds to the flow rate coefficient, and A1 (PI) corresponds to the characteristic of A1 of FIG. 5. In the substitution operation mode, the meter-out opening is not limited, so that the characteristic of the meter-out restrictor opening is the meter-out opening characteristic A0 of the control valve 41. To prevent the breathing phenomenon, it is necessary to maintain, also in the substitution operation mode, a meter-out pressure equivalent to that of the normal operation mode. Here, A1 is smaller than A0, so that, as in the case of equation (2), a positive-value pump correction flow rate ΔQ is added to the pump reference flow rate Q. From equations (1) and (2), the pump correction flow rate ΔQ is determined uniquely as in equation (3).

While in the above description one operation mode is automatically selected based on the flowchart of FIG. 3, that is, the hydraulic working fluid temperature, it is also possible to provide an operation mode changeover switch (not shown), and, by this switch, the switching positions of the switch SW1 and the switch SW2 may be changed in accordance with the operation mode as desired by the operator.

As described above, in the present embodiment, there is provided a hydraulic excavator including: a hydraulic pump 23 pumping up and delivering the hydraulic working fluid in a hydraulic working fluid tank 40; an arm cylinder 34 driven by the hydraulic working fluid delivered from the hydraulic pump 23; a meter-out passage L4 through which the hydraulic working fluid discharged from the arm cylinder 34 flows; a control valve 41 provided in the meter-out passage L4 and configured to control the flow rate of the hydraulic working fluid in the meter-out passage L4 by changing the opening area of a restrictor 41*j*; a pressure sensor SE5 detecting the load (actuator load) acting on the arm cylinder 34; an operation device 42 operating the arm cylinder 34; and a pressure sensor SE3 detecting the operation amount of the operation device 42. In the hydraulic excavator, there is provided a controller 44 configured to control the opening area of the restrictor 41*j* by selecting one of a normal operation mode in which the opening area of the restrictor 41*j* is controlled based on the actuator load detected by the sensor SE5 and the operation amount detected by the sensor SE3, and a substitution operation mode in which the actuator load is not taken into consideration and in which the opening are of the restrictor 41*j* is controlled based solely on the operation amount detected by the sensor SE3. Further, the controller 44 is configured to increase the delivery flow rate of the hydraulic pump 23 when the substitution operation mode is selected as compared with the case where the normal operation mode is selected and where the operation amount is the same.

In the hydraulic excavator constructed as described above, the opening area of the restrictor 41*j* of the control valve 41 is controlled, whereby, in the case where the flow rate of the hydraulic working fluid in the meter-out passage (L4) is not controlled in accordance with the actuator load (that is, in the case where the substitution operation mode is selected), the delivery flow rate of the hydraulic pump 23 increases as compared with the case where the normal operation mode is selected, making it possible to avoid a shortage of hydraulic working fluid flow rate in the meter-in passage (L3). Thus, it is possible to prevent generation of the breathing phenomenon in the arm cylinder (hydraulic actuator) 34. As a result, it is possible to prevent deterioration in the operability of the hydraulic excavator and damage of the hydraulic apparatus.

Further, in the present embodiment, due to the provision of the table T3, the controller 44 performs control, when the substitution operation mode is selected, such that the smaller the actuator load, the higher the delivery flow rate of the hydraulic pump 23, and that the larger the operation amount, the higher the delivery flow rate of the hydraulic pump 23.

In the hydraulic excavator constructed as described above, the smaller the actuator load, and the higher the possibility of generation of the breathing phenomenon, the higher the delivery flow rate of the hydraulic pump 23, so that it is possible to achieve an improvement in terms of the reliability in the prevention of the generation of the breathing phenomenon.

Further, in the present embodiment, there is further provided the temperature sensor SE7 detecting the hydraulic working fluid temperature in the hydraulic working fluid tank 40. When the hydraulic working fluid temperature T0 acquired by the temperature sensor SE7 is below the threshold value T1, the controller 44 selects the substitution operation mode, and when the hydraulic working fluid temperature attains a value (T2) that is the threshold value T1 or more, the controller selects the normal operation mode.

In the hydraulic excavator constructed as described above, when the hydraulic working fluid temperature is lowered due to the external air temperature, etc., and the viscosity of the hydraulic working fluid becomes so high as to make it difficult to perform the meter-out opening limitation control (i.e., to control the hydraulic working fluid flow rate in the meter-out passage (L4) in accordance with the actuator load through the control of the opening area of the restrictor 41*j* of the control valve 41), the substitution operation mode is automatically selected, and the execution of the meter-out opening limitation control is avoided. Further, the delivery flow rate of the hydraulic pump 23 increases. As a result, the execution/non-execution of the meter-out flow rate control in accordance with the load is automatically selected in accordance with the hydraulic working fluid temperature, and, at the same time, even when the meter-out flow rate control is not executed, it is possible to prevent generation of the breathing phenomenon in the arm cylinder (hydraulic actuator) 34, so that it is possible to prevent deterioration in the operability of the hydraulic excavator and damage of the hydraulic apparatus.

Second Embodiment

Figure 8:
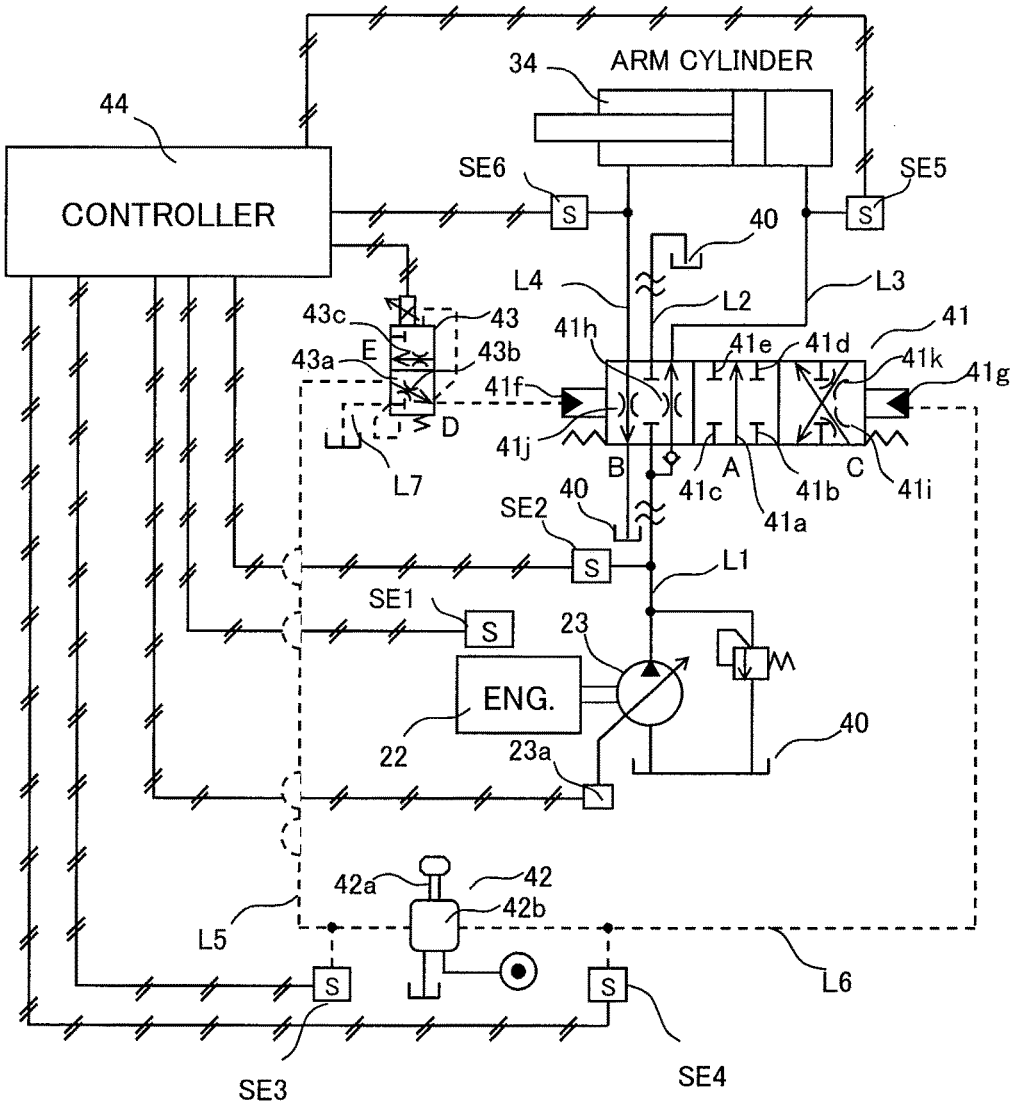
FIG. 8 is a conceptual diagram illustrating the construction of a hydraulic circuit and an apparatus according to a second embodiment of the present invention.

Next, the second embodiment of the present invention will be described. FIG. 8 is a construction diagram of a hydraulic circuit and an apparatus according to the present embodiment. The construction of the hydraulic circuit and the apparatus differs from that of the first embodiment in that the hydraulic working fluid temperature sensor SE7 is removed. Otherwise, it is the same as that of the first embodiment, so that a description thereof will be left out.

Figure 13:
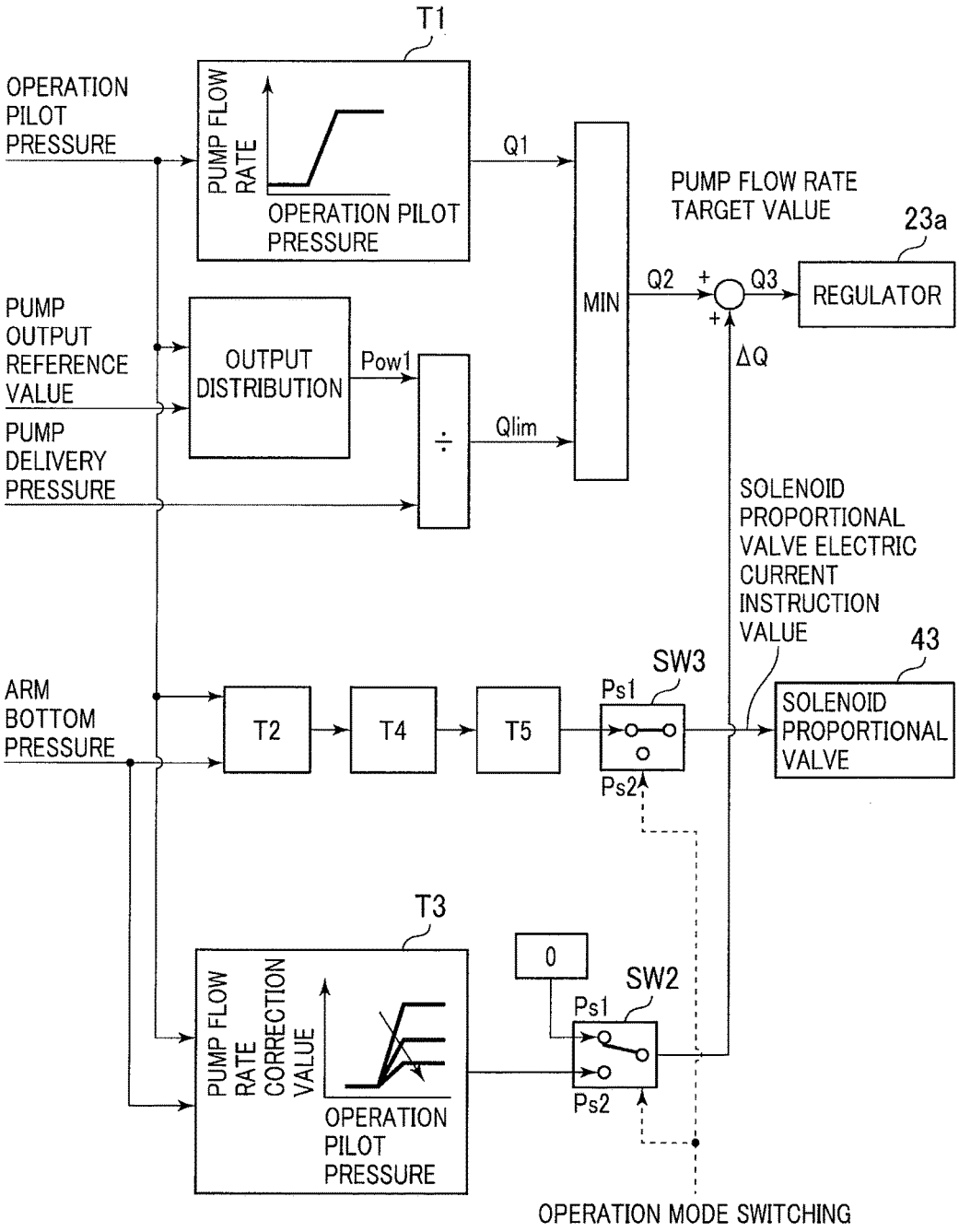
FIG. 13 is a conceptual diagram illustrating the construction of a hydraulic circuit and an apparatus according to the second embodiment of the present invention.

FIG. 13 is a control block diagram illustrating the hydraulic pump and the meter-out opening limitation computation. In FIG. 13, reference character T2 indicates the table T2 in FIG. 4, and reference characters T4 and T5 indicate the tables T4 and T5 in FIG. 5. The difference from the control block diagrams of FIGS. 4 and 5 lies in the fact that there is provided a switch SW3 instead of the switch SW1. The switching position for the switch SW3 is alternatively switched in accordance with the operation mode determined in the flowchart of FIG. 9 referred to below. In the normal operation mode, the switch SW3 is switched to a position Ps1, and an electric current instruction value calculated by using the tables T2, T4, and T5 is output to the solenoid proportional valve 43. On the other hand, in the substitution operation mode, the switch SW3 is switched to a position Ps2, and the electrical connection between the controller 44 and the solenoid proportional valve 43 is cut off. As a result, the electric current output to the solenoid proportional valve 43 is not effected (that is, the electric current instruction value is zero), and the solenoid proportional valve 43 assumes a maximum opening at the normal position. As a result, the control valve 41 is driven by the pilot pressure generated by the operation pilot pressure generation portion 42*b* independently of the actuator load.

Figure 9:
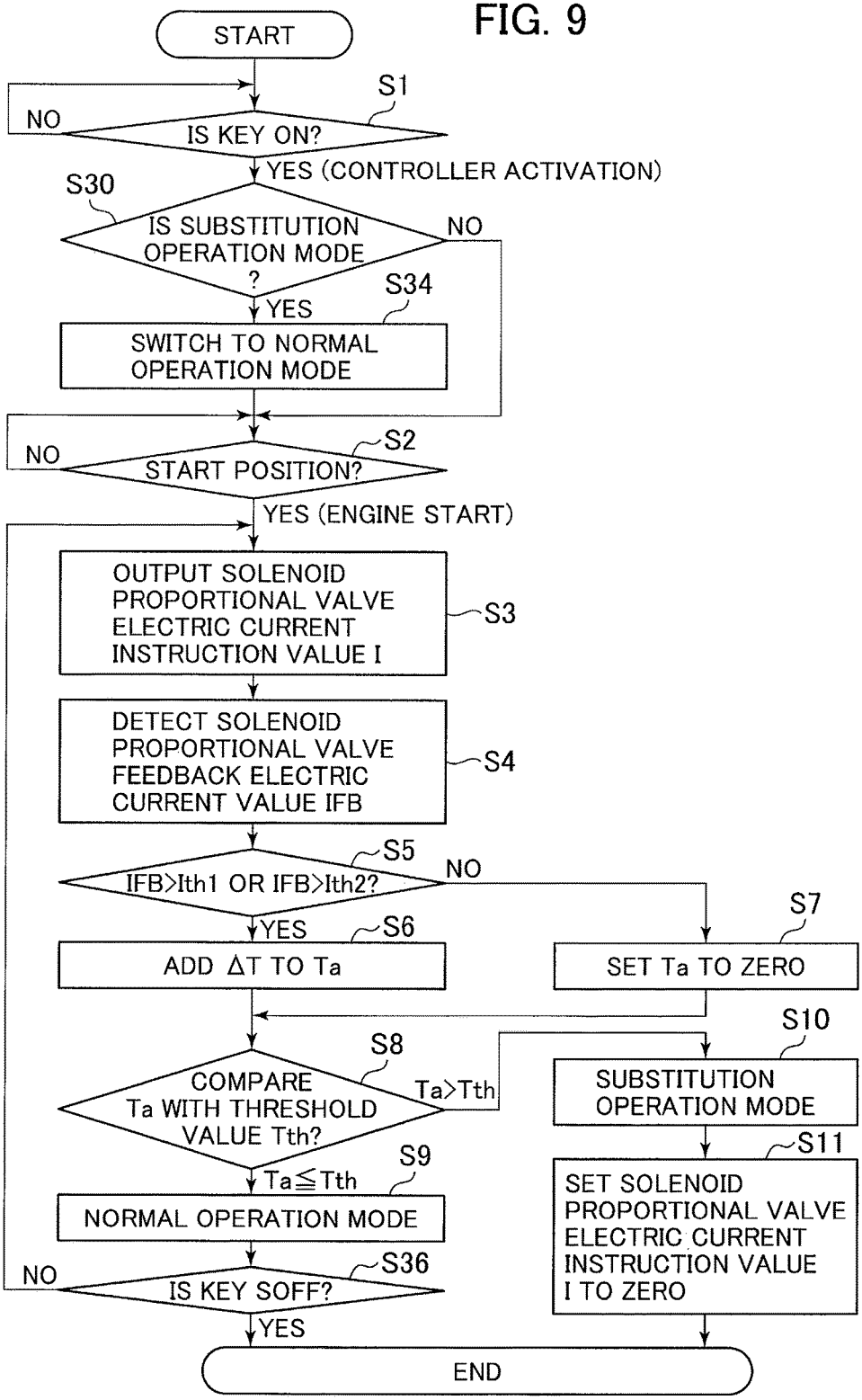
FIG. 9 is a flowchart illustrating an operational mode switching control according to the second embodiment of the present invention.

FIG. 9 shows the operation mode switching control flowchart of the first embodiment. The same processing as that in the above flowchart is indicated by the same reference character, and a description thereof may be left out.

When it is confirmed that the key switch is at the ON position in step S1, the controller 44 is activated, and the procedure advances to step S30.

In step S30, the controller 44 determines whether or not the operation mode when the key was OFF last time was the substitution mode. The operation mode when the key was OFF last time is stored in the ROM 93 of the controller 44, and the controller 44 makes the determination in step S30 based on the information. When it is determined in step S30 that the operation mode was the substitution mode, the operation mode is switched to the normal operation mode in step S34, and the procedure advances to step S2. On the other hand, when in step S30 the mode was determined to be the normal operation mode, the procedure advances to step S2.

In step S3, the controller 44 outputs a solenoid proportional valve electric current instruction value I, which is determined by the control shown in FIG. 13. In step S4, a current sensor of the controller 44 detects an electric current (feedback electric current value) IFB output to the solenoid proportional valve 43, and the procedure advances to step S5. There may be constructed such that, in step S3, the presence or absence of an output demand for the solenoid proportional valve electric current instruction value I is detected, and when there is the output demand, the procedure advances to step S4, and when there is no output demand, the procedure may return to step S3 (See step S40 of FIG. 14 referred to below).

In step S5, it is determined whether or not either the solenoid proportional valve feedback electric current IFB of S4 exceeds a feedback electric current upper limit threshold value Ith1 (e.g., 900 mA) or it is below a feedback electric current lower limit threshold value Ith2 (e.g., 50 mA). Here, Ith1 is a value larger than the solenoid proportional valve maximum electric current IMAX, and is an electric current value making it possible to determine whether or not the solenoid or wire harness of the solenoid proportional valve 43 suffers short-circuiting. Ith2 is a value smaller than the solenoid proportional valve minimum electric current IMIN and not less than zero, and is an electric current value making it possible to determine whether or not the solenoid or wire harness of the solenoid proportional valve 43 suffers disconnection. That is, in step S5, it is determined whether or not there is failure accompanying short-circuiting/disconnection of the solenoid proportional valve 43. When, in step S5, either the solenoid proportional valve feedback electric current IFB exceeds a feedback electric current upper limit threshold value Ith1 or it is below a feedback electric current lower limit threshold value Ith2 (that is, when there is a fear of short-circuiting/disconnection), the procedure advances to step S6.

In step S6, the computation cycle (e.g., 0.01 sec) of the controller 44 is added to a timer Ta (the initial value of which is zero), and the procedure advances to step S8.

On the other hand, when, in step S5, the solenoid proportional valve feedback electric current IFB is equal to or less than the feedback electric current upper limit threshold value Ith1 or it is equal to or more than the feedback electric current lower limit threshold value Ith2, the procedure advances to step S7. In step S7, the timer Ta is set to zero, and the procedure advances to step S8.

In step S8, the timer Ta and a timer threshold value Tth (e.g., 5 sec) are compared with each other. When the timer Ta is equal to or less than the timer threshold value Tth, the procedure advances to step S9. When the timer Ta is more than the timer threshold value Tth, it is determined that abnormality is generated in the solenoid proportional valve 43 (meter-out control valve control device), and the procedure advances to step S10.

In step S9, the operation mode of the machine body is set to the normal operation mode, and it is determined whether or not the key switch is at the OFF position (S36). When, in step S36, the key is OFF, the engine 22 and the controller 44 are stopped to complete the processing. When the key is ON, the procedure returns to step S3.

In step S10, the controller 44 switches the operation mode of the machine body to the substitution operation mode, and the switch SW3 is switched to the position Ps2. As a result, the solenoid proportional valve electric current instruction value I is set to zero in step S11 (that is, the control valve 41 is driven by the pilot pressure generated by the operation pilot pressure generation portion 42*b*), and the processing is completed. As a result, in the case where switching is effected to the substitution operation mode, switching to the normal operation mode is not effected so long as the turning OFF/ON of the key is not performed next time.

While in the above-described case the operation mode when the key was OFF last time is stored and it is confirmed in step S30, the storage of the operation mode and steps S30 and S34 may be omitted, and it is possible to adopt a construction in which the operation mode at the start of the flow of FIG. 9 is always the normal operation mode.

When trouble or failure is generated in the solenoid proportional valve 43, it is difficult to output a proper secondary pressure from the solenoid proportional valve 43, so that it is impossible to perform a proper meter-out flow rate control in accordance with the actuator load.

In view of this, in the present embodiment, constructed as described above, the hydraulic excavator is constructed as follows. Driving is effected based on the solenoid proportional valve electric current instruction value I (control signal) input from the controller 44. When the controller 44 detects abnormality in the solenoid proportional valve 43 functioning as the meter-out control valve control device controlling the opening area of the restrictor 41*j* of the control valve 41, the output of the electric current to the solenoid proportional valve 43 is stopped, and the substitution operation mode is selected as the operation mode.

When the hydraulic excavator is thus constructed, in the case where the meter-out flow rate control cannot be performed due to failure of the solenoid proportional valve 43, the operation mode is automatically switched to the substitution operation mode, and the pump flow rate increases, so that it is possible to prevent the breathing phenomenon.

In the above-described system, in order to prevent an erroneous electric current from being output to the solenoid proportional valve 43 due to failure in the solenoid proportional valve 43 and the peripheral equipment thereof, the connection between the solenoid proportional valve 43 and the controller 44 is interrupted by SW3 in the substitution operation mode. Instead of the control of the solenoid proportional valve 43 of FIG. 13, however, the control may be performed based on FIGS. 4 and 5 as in the first embodiment.

Third Embodiment

Next, the third embodiment of the present invention will be described. In the third embodiment, the breathing phenomenon is prevented also in the case where the sensor used for the meter-out opening limitation computation suffers failure. In the following, the arm cylinder bottom pressure sensor SE5 will be taken as an example of the sensor used for the meter-out opening limitation computation. The construction of the hydraulic circuit and the apparatus is the same as that of the second embodiment of the present invention.

Figure 11:
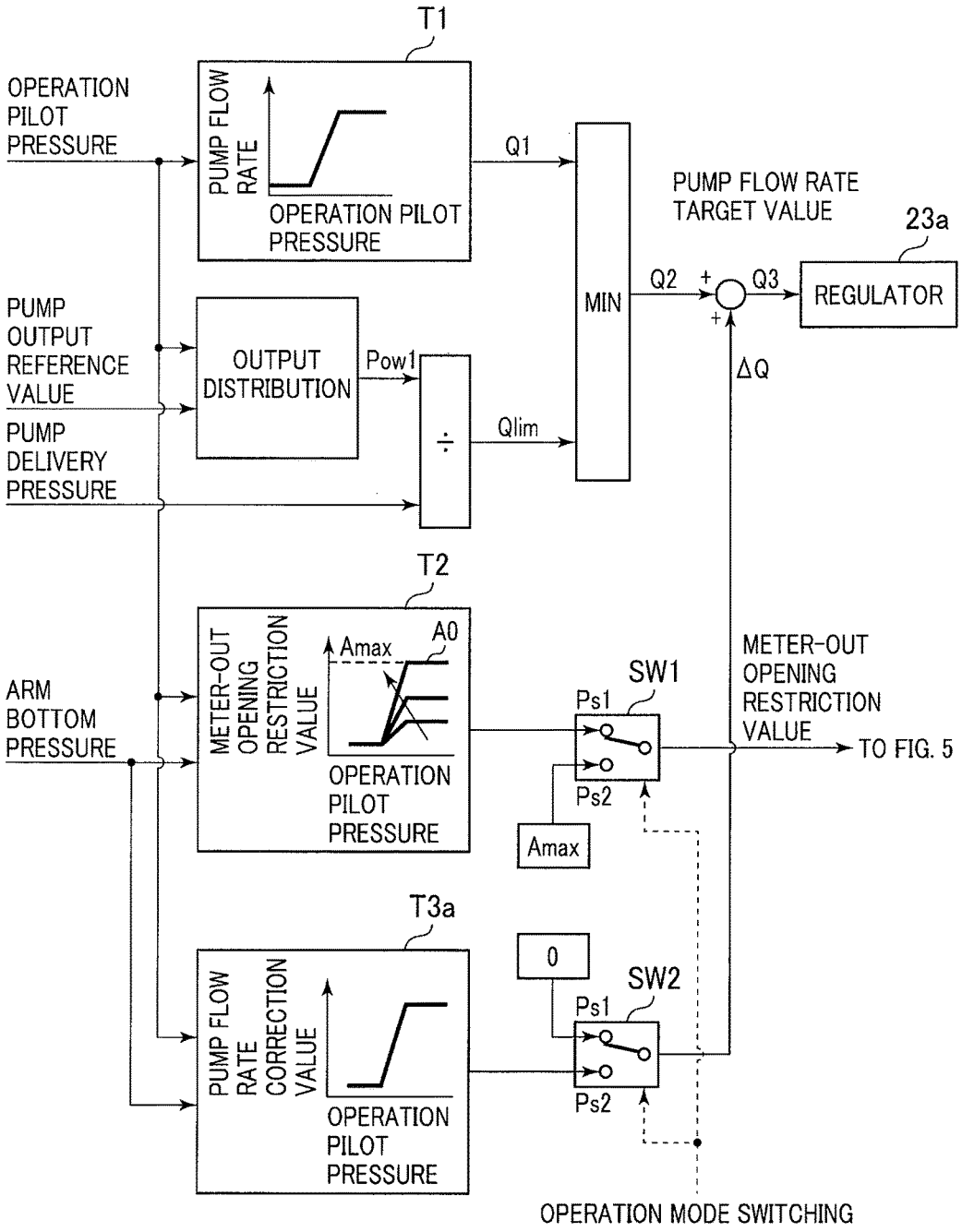
FIG. 11 is a control block diagram of a hydraulic pump and a meter-out opening limitation computation according to the third embodiment of the present invention.

FIG. 11 shows a method of controlling the delivery flow rate of the hydraulic pump 23 and the solenoid proportional valve 43 in the normal operation mode and the substitution operation mode in the present embodiment. The method of controlling the delivery flow rate of the hydraulic pump 23 and the solenoid proportional valve 43 is substantially the same as that of the first embodiment. The only difference lies in the fact that the pump correction flow rate $\Delta Q$ is computed solely from the operation pilot pressure (table T3*a*) without using the arm bottom pressure. In the table T3*a* of this example, there is utilized the characteristic when the arm bottom pressure is minimum in the table T3 of FIG. 4.

Figure 10:
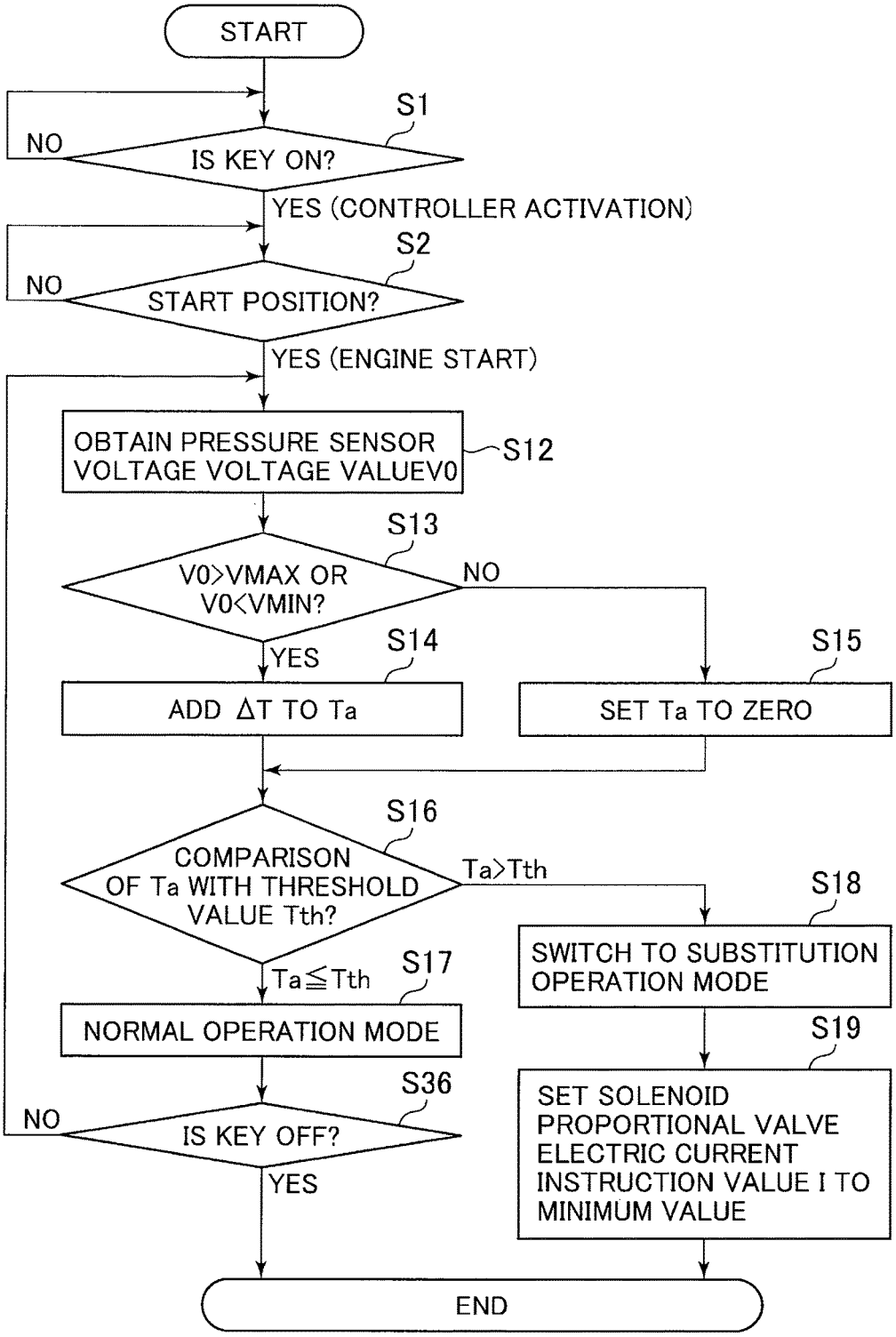
FIG. 10 is a flowchart illustrating an operational mode switching control according to a third embodiment of the present invention.

FIG. 10 shows the flowchart for the operation mode switching control in the present embodiment. Steps S1 and S2 are the same as those of the first embodiment. Next, in step S12, the output voltage V0 of the arm bottom pressure sensor SE5 is detected, and the procedure advances to step S13. In step S13, it is determined whether or not either the cylinder pressure sensor voltage V0 is below the cylinder pressure sensor voltage minimum value VMIN or it exceeds the cylinder pressure sensor voltage maximum value VMAX. The cylinder pressure sensor voltage minimum value VMIN is of a value making it possible to detect short-circuiting of the cylinder pressure sensor. The cylinder pressure sensor voltage maximum value VMAX is of a value making it possible to detect disconnection of the cylinder pressure sensor. When either the cylinder pressure sensor voltage V0 is below the cylinder pressure sensor voltage minimum value VMIN or it exceeds the cylinder pressure sensor voltage maximum value VMAX, the procedure advances to step S14. Otherwise, the procedure advances to step S15.

In step S14, the computation cycle of the controller 44 is added to the timer Ta (the initial value of which is zero), and the procedure advances to step S16.

In step S15, the timer Ta is set to zero, and the procedure advances to step S16.

In step S16, the timer Ta and the timer threshold value Tth (e.g., 5 sec) are compared with each other. When the timer Ta is equal to or less than the timer threshold value Tth, the procedure advances to step S17, and when the timer Ta is more than the timer threshold value Tth, the procedure advances to step S18.

In step S17, the operation mode of the machine body is set to the normal operation mode (the initial state is the normal mode), and the procedure advances to step S36.

On the other hand, in step S18, the operation mode of the machine body is switched to the substitution operation mode, and the procedure advances to step S19. In step S19, the electric current instruction value of the solenoid valve 43 is reduced to a minimum value (which is an electric current value at which the solenoid valve 43 is maintained at the normal position and which can, for example, be zero), and the processing is completed.

In the case where the sensor used for controlling the operation of the control valve 41 such as the cylinder pressure sensor SE5 suffers failure, it is difficult to property adjust the meter-out restrictor opening which is necessary for preventing the breathing phenomenon. Thus, in this case, the meter-out flow rate control should not be performed at least by the conventional method.

In view of this, in the present embodiment, the hydraulic excavator is constructed such that the controller 44 selects the substitution operation mode when abnormality of the sensor SE5 is detected.

Due to this construction of the hydraulic excavator, even in the case where the sensor used for the meter-out flow rate control suffers failure and where the control valve 41 cannot be controlled by the conventional method, it is possible to prevent the breathing phenomenon by increasing the pump flow rate.

In particular, in the table T3*a* of FIG. 11, the characteristic when the arm bottom pressure is minimum in the table T3 of FIG. 4 (that is, the characteristic in the case where the possibility of generation of breathing is highest) is utilized. When the pump correction flow rate $\Delta Q$ is thus computed, the hydraulic working fluid on the meter-in side is secured to the maximum even in the case where abnormality is generated in the bottom pressure sensor SE5, so that it is possible to prevent generation of the breathing phenomenon.

Fourth Embodiment

Next, the fourth embodiment of the present invention will be described. In the fourth embodiment, when abnormality of the meter-out control valve control device is overcome, and a permission signal permitting the change from the substitution operation mode to the normal operation mode is input, switching is effected from the substitution operation mode to the normal operation mode.

Figure 14:
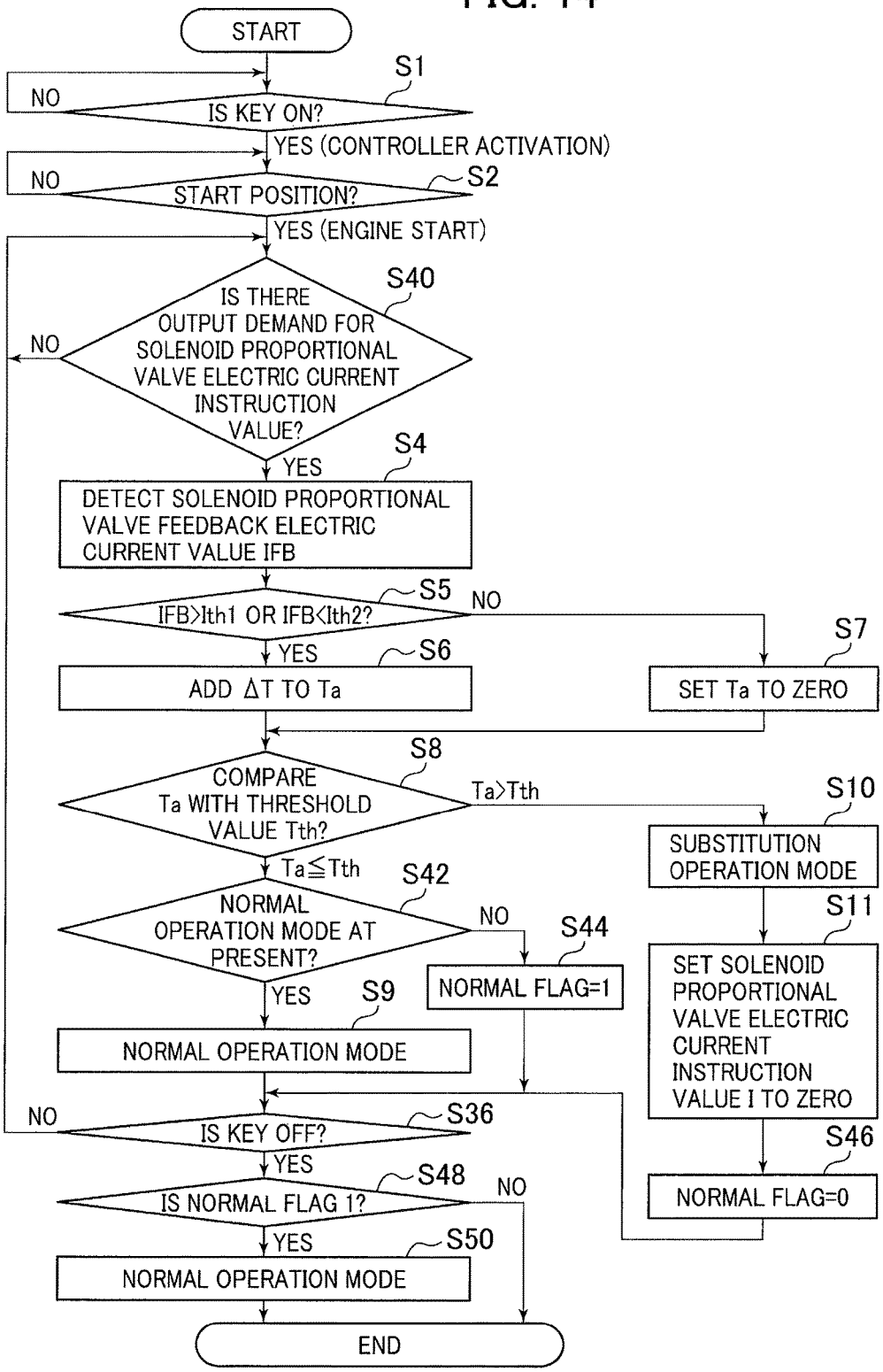
FIG. 14 is a flowchart illustrating an operational mode switching control according to a fourth embodiment of the present invention.

FIG. 14 is a flowchart illustrating the operation mode switching control according to the fourth embodiment. Otherwise, the present embodiment is of the same construction as the second embodiment, and a redundant description thereof will be left out.

In step S8, the timer Ta and the timer threshold value Tth (e.g., 5 sec) are compared with each other. When the timer Ta is equal to or lower than the timer threshold value Tth, the procedure advances to step S42.

In step 42, the controller 44 determines whether or not the current operation mode is the normal operation mode. In the case of the normal operation mode, the procedure advances to step S9, and, in the case of the substitution operation mode, the procedure advances to step S44.

In step S44, a flag for determining whether or not failure of the solenoid proportional valve 43 is overcome (which is referred to as the normal flag) is set to 1, and the procedure advances to step S36. When the normal flag is 0, it indicates that abnormality is generated in the solenoid proportional valve 43, and when the normal flag is 1, it indicates that the abnormality of the solenoid proportional valve 43 is overcome.

In the case where it is determined in step S36 that the key switch is at the OFF position and where the non-operation of the front work device 30 is secured, it is determined in step S48 whether or not the normal flag is 1. When the normal flag is 1, the operation mode is changed from the substitution operation mode to the normal operation mode to complete the processing. When the normal flag is 0, the processing is completed, with the operation mode remaining the normal operation mode. In step S36, it is determined whether or not the key switch is at the OFF position based on a signal (referred to as the permission signal) which is input to the controller 44 when the key switch is switched to the OFF position. The permission signal is a signal permitting the change from the substitution operation mode to the normal operation mode.

When the operation mode is restored from the substitution operation mode to the normal operation mode using as a trigger solely the fact that the abnormality of the solenoid proportional valve 43 is overcome, there is the possibility of the operation mode being changed during the operation of the front work device 30 to thereby impair the operational sensation for the operator.

However, in the hydraulic excavator constructed as described above, the operation mode is restored to the normal operation mode using as a trigger the fact that the abnormality generated in the solenoid proportional valve 43 is overcome and that the key switch is switched to the OFF position to guarantee the non-operation of the front work device 30. Thus, it is possible to avoid a change in operation mode during the operation of the front work device 30, making it possible to maintain a satisfactory operational sensation for the operator. Further, in the case where the abnormality of the solenoid proportional valve 43 is overcome, it is possible for the operation mode to be quickly restored to the normal operation mode.

While in the above description the permission signal is output to the controller 44 when the key switch is switched to the OFF position, the permission signal may also be output in other cases so long as the non-operation of the front work device 30 is guaranteed. For example, the permission signal can be output in the following cases: a case where the key switch is switched to the ON position or the start position; a case where there is erected a gate lock lever (not shown) controlling as to whether or not the pilot pressure is output from the pilot valve 42 to the control valve 41 (a case where switching is effected to the pilot pressure interrupting position); a case where an automatic idling control of the engine 22 is started; and a case where the operation lever 42*a* is not operated for a predetermined period of time. Further, a dedicated switch for the output of the permission signal may be installed in the cab, making it possible to output the permission signal with a timing as desired by the operator. In this case, the control of the present embodiment is also applicable to the first embodiment.

The present embodiment is also applicable to the case where abnormality of a sensor according to the third embodiment (e.g., the sensor SE5) is overcome.

Additional Remark

While in the above description the pressure sensor SE5 detecting the bottom pressure of the arm cylinder 34 is utilized as the load sensor of the arm cylinder 34, the pressure sensor SE6 may be utilized as the load sensor in addition to the pressure sensor SE5. In this case, it is possible to detect the load of the arm cylinder 34 from the differential pressure between the pressure sensors SE5 and SE6. Further, instead of the pressure sensor SE5, the pressure sensor SE2 detecting the pump delivery pressure may be utilized as the load sensor.

The first embodiment is constructed such that, from the viewpoint of preventing a frequent change in the operation mode as a result of frequent fluctuation in a short period of time of the hydraulic working fluid temperature around the threshold value T1, the substitution mode is selected when the hydraulic working fluid temperature T0 is below the threshold value T1, and the normal operation mode is selected when the hydraulic working fluid temperature T0 attains a value (T2) that is equal to or more than the threshold value TO. That is, the two threshold values of T1 and T2 are used. However, in the case of use etc. in an environment in which the hydraulic working fluid temperature increases or decreases monotonously, only one threshold value may be used. Further, while in the above example the maximum value of the temperature range where the meter-out opening limitation control is difficult is T1, this should not be construed restrictively. A desired value can be set as T1 in accordance with the viscosity of the hydraulic working fluid.

While in the flowchart of each embodiment described above the point in time when the key switch is switched to the start position (S1 and S2) is the actual point in time when the processing is started, steps S1 and S2 may be omitted, starting the processing at an appropriate point in time after the activation of the controller and after the start of the engine. Further, the order in which the processing of each flowchart is conducted may be changed as appropriate so long as the result attained is the same.

While in the above description the flow rate control of the meter-out passage (actuator line) L4 is performed by the restrictor 41*j* in the control valve 41, the meter-out flow rate control system is not restricted thereto but allows various modifications. For example, it is possible to connect some other passage to the actuator line L4, and to control the opening area of a variable restrictor provided in that passage. Further, the meter-out flow rate may be controlled by the sum total of the opening area of that variable restrictor and that of the restrictor 41*j*.

DESCRIPTION OF REFERENCE CHARACTERS

10: Track structure
11: Crawler
12: Crawler frame
13: Traveling hydraulic motor
20: Swing structure
21: Swing frame
22: Engine
23: Hydraulic pump
23*a*: Pump regulator
24: Control valve unit
25: Swing hydraulic motor
30: Front work device
31: Boom
32: Boom cylinder
33: Arm
34: Arm cylinder (hydraulic actuator)
35: Bucket
36: Bucket cylinder
40: Hydraulic working fluid tank
41: Control valve (meter-out control valve)
42: Pilot valve (operation device)
43: Solenoid proportional valve
44: Controller (control device)
SE1: Engine speed pickup sensor
SE2: Pump delivery pressure sensor
SE3: Operation pilot pressure sensor (arm crowding operation)
SE4: Operation pilot pressure sensor (arm damping operation)
SE5: Arm bottom pressure sensor
SE6: Arm rod pressure sensor
SE7: Hydraulic working fluid temperature sensor
SW1: Switch
SW2: Switch
SW3: Switch
L1: Delivery line
L2: Center bypass line
L3: Actuator line (arm bottom side)
L4: Actuator line (arm rod side meter-out passage)
L5: Pilot line (arm crowding)
L6: Pilot line (arm damping)
L7: Drain hydraulic fluid line

The invention claimed is:

1. A construction machine comprising:

a hydraulic pump pumping up a hydraulic working fluid in a tank and delivering it;

a hydraulic actuator driven by the hydraulic working fluid delivered from the hydraulic pump;

a meter-out passage through which the hydraulic working fluid discharged from the hydraulic actuator flows;

a meter-out control valve provided in the meter-out passage and controlling the hydraulic working fluid flow rate in the meter-out passage by varying an opening area;

a load sensor detecting a load acting on the hydraulic actuator;

an operation device operating the hydraulic actuator; and an operation amount sensor detecting an operation amount of the operation device, the construction machine further comprising a control device configured to alternatively select a normal operation mode in which the opening area of the meter-out control valve is controlled based on the load and the operation amount and a substitution operation mode in which the opening area of the meter-out control valve is controlled based on the operation amount, wherein the control device is configured to further increase a delivery flow rate of the hydraulic pump when the substitution operation mode is selected than when the normal operation mode is selected.

2. The construction machine according to claim 1, wherein, when the substitution operation mode is selected, the control device increases the delivery flow rate of the hydraulic pump the smaller the load, and increases the delivery flow rate of the hydraulic pump the larger the operation amount.

3. The construction machine according to claim 1, further comprising a temperature sensor detecting a hydraulic working fluid temperature in the tank, wherein the control device selects the substitution operation mode when the hydraulic working fluid temperature is below a threshold value, and selects the normal operation mode when the hydraulic working fluid temperature attains a value that is equal to or more than the threshold value.

4. The construction machine according to claim 1, further comprising a meter-out control valve control device driven based on a control signal input from the control device and configured to control the opening area of the meter-out control valve, wherein the control device selects the substitution operation mode when abnormality of the meter-out control valve control device is detected.

5. The construction machine according to claim 1, wherein the control device selects the substitution operation mode when abnormality of the load sensor is detected.

6. The construction machine according to claim 4, wherein the control device selects the normal operation mode instead of the substitution operation mode when the abnormality is overcome after the substitution operation mode is once selected, and when there is input a permission signal permitting the change from the substitution operation mode to the normal operation mode.

* * * * *